US006609755B2

(12) United States Patent
Koepke et al.

(10) Patent No.: US 6,609,755 B2
(45) Date of Patent: Aug. 26, 2003

(54) ERGONOMIC CHAIR

(75) Inventors: Marcus C. Koepke, Indianapolis, IN (US); Jamie Krull, Coralville, IA (US); Jay R. Machael, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 09/882,237

(22) Filed: Jun. 15, 2001

(65) Prior Publication Data

US 2002/0190553 A1 Dec. 19, 2002

(51) Int. Cl.[7] ..... A47C 1/024; A47C 1/038; A47C 3/026

(52) U.S. Cl. ..... 297/300.2; 297/300.1; 297/300.3

(58) Field of Search ..... 297/300.2, 300.1, 297/300.3, 300.4

(56) References Cited

U.S. PATENT DOCUMENTS

| | | | | | |
|---|---|---|---|---|---|
| RE250,207 | | * | 6/1961 | Reed | 297/300.3 |
| 4,143,910 | A | * | 3/1979 | Geffers et al. | 297/300.3 |
| 4,200,332 | A | * | 4/1980 | Brauning | 297/300.3 |
| 4,537,445 | A | * | 8/1985 | Neuhoff | 297/300.3 |
| 4,629,249 | A | * | 12/1986 | Yamaguchi | 297/300.3 |
| 4,682,814 | A | * | 7/1987 | Hansen | 297/300.3 |
| 4,684,173 | A | * | 8/1987 | Locher | 297/300.3 |
| 4,709,962 | A | * | 12/1987 | Steinmann | 297/300.3 |
| 4,761,033 | A | * | 8/1988 | Lanuzzi et al. | 297/300.3 X |
| 4,783,121 | A | | 11/1988 | Luyk et al. | 297/300.2 |
| 4,834,453 | A | * | 5/1989 | Makiol | 297/300.4 |
| 4,877,291 | A | | 10/1989 | Taylor | 297/322 X |
| 5,251,958 | A | | 10/1993 | Roericht et al. | 297/322 X |
| 5,318,345 | A | | 6/1994 | Olson | 297/300.5 |
| 5,366,274 | A | | 11/1994 | Roericht et al. | 297/321 |
| 5,425,566 | A | * | 6/1995 | Buchacz | 297/300.3 |
| 5,547,252 | A | * | 8/1996 | Pfenniger | 297/300.3 |
| 5,660,439 | A | * | 8/1997 | Unwalla | 297/300.2 X |
| 5,860,701 | A | | 1/1999 | Jungjohann et al. | 297/300.2 X |
| 5,934,758 | A | * | 8/1999 | Ritch et al. | 297/300.2 X |
| 6,109,694 | A | * | 8/2000 | Kurtz | 297/300.2 X |
| 6,155,645 | A | * | 12/2000 | Bedrich | 297/300.3 X |
| 6,161,897 | A | * | 12/2000 | Kurtz et al. | 297/300.2 X |
| 6,382,719 | B1 | * | 5/2002 | Heidmann et al. | 297/300.1 X |

* cited by examiner

*Primary Examiner*—Rodney B. White
(74) *Attorney, Agent, or Firm*—Jones Day

(57) ABSTRACT

An ergonomic chair includes a four-bar linkage arrangement wherein a lower frame member is provided with a rigid front support and a rigid rear support with a seat member pivotably connected to the front support. A back rest has an upper support pivotably connected at an upper end of the rear support of the lower frame member. A link member pivotably connects at a first end to a rear support of the seat member and at second end to a lower support of the back rest. This novel arrangement permits tilting movement of the backrest rearwardly relative to the lower frame member causing elevation of a rear portion of the seat member, permitting the feet to remain on the floor and alleviating pressure on the user's thighs.

18 Claims, 16 Drawing Sheets

ERGONOMIC CHAIR

BACKGROUND OF THE INVENTION

1. Field of the Invention

The present invention relates generally to a chair of the type suitable for use in an office environment and, more particularly, to a reclining office chair having several structural and operating features which offer a number of ergonomic advantages over the prior art.

2. Description of the Related Art

Over many years attempts have been made to design chairs for use in office environments which are comfortable to use and thereby avoid user fatigue over prolonged use. In one simple form a chair may be provided with a swivel base for ease of turning and include a control mechanism which permits the chair to rock. A disadvantage of these relatively simple chairs is that conjoint rocking motion of the chair seat and back naturally lifts the user's feet off the floor, which can create stability problems and place upward force on the front of the user's thighs which can reduce fluid circulation in the user's legs.

To improve on the foregoing chair construction, chair controls are known which provide for synchronous movement of the chair seat and back. Where office chairs are concerned, a "synchronous control" means the arrangement of a combined or dependent back adjustment and seat adjustment, that is to say the adjustment of the back inclination fundamentally also results in an adjustment of the sitting surface. An example of a synchronous chair control is disclosed in U.S. Pat. No. 5,318,345, issued to Olson and assigned to the common assignee herein. With the aforementioned Olson control, the chair back is designed to tilt at one predetermined rate of recline while the seat tilts synchronously at a much lesser rate. The result is that the user's feet are not lifted from the floor when the back is reclined. Also, fluid circulation in the user's legs is not interrupted by substantial upward movement of the forward end of the seat. Another advantage of this control is that undesirable "shirt pull" is minimized by the strategic location of the tilt axis. Other examples of synchronous chair controls are disclosed in U.S. Pat. Nos. 5,366,274 and 5,860,701 to name a few.

Another feature embodied in recently designed office chairs that offers considerable ergonomic advantages is a tilt limiter feature for the chair back. With such a mechanism built into the chair control, the user may selectively set the degree of back recline at a predetermined angle thereby adding to comfort as the chair is used. An example of such a tilt limiter mechanism is disclosed in U.S. Pat. No. 6,102,477 issued to Kurtz and assigned to the common assignee herein. This particular mechanism offers the advantage of providing for infinitely variable angles of tilt within a predetermined overall range. The mechanism is also highly cost-effective to construct.

Yet another feature of current ergonomically designed chairs is the provision of height and pivot adjustable arm pads. Such a feature is particularly advantageous in providing the user with additional support to the arms, forearms, wrists and shoulders in order to minimize repetitive stress injuries when the user is keyboarding, for example, while seated in the chair. An example of such an adjustable arm pad is disclosed in U.S. Pat. No. 5,908,221 issued to Neil. One advantage of the '221 structure is that it uses gas cylinders for arm pad height adjustment and thus is easily adjusted with the push of a single button.

Yet another feature of current ergonomically designed office chairs includes an adjustable lumbar support mechanism for providing preselected chair back tension in the region of the user's lower back. An adjustable lumbar support allows the chair user to select a comfortable level of pressure on the lower back depending upon the specific office task being performed. Such a mechanism is disclosed, for example, in U.S. Pat. No. 5,797,652.

Still another feature of certain ergonomically designed office chairs, particularly of recent vintage, is the incorporation of fabric mesh into the construction of the chair seat, and/or back. While mesh materials are well-known in the construction of lawn furniture seating, it has only been relatively recently that such materials have been used successfully in office seating. These materials offer the advantage of enhanced air circulation for and consequent heat transfer from the chair user's body, which can improve the comfort of the chair. An example of the use of such fabric mesh in an office chair is disclosed in U.S. Pat. No. 6,125,521 issued to Stumpf et al.

Yet another feature of certain ergonomically designed chairs is the provision of a seat cushion having the capability of effecting heat transfer from the chair user's buttocks area while at the same time offering comfort to the user while seated, together with adequate support. Known seat cushions having such capability may involve a passive or active air flow circulation feature of the type disclosed, for example, in U.S. Pat. No. 6,179,706.

SUMMARY OF THE INVENTION

The present invention provides a totally redesigned ergonomic chair that incorporates improved functional aspects in all areas of a modular chair construction and in its use, including tilt limit control, seat adjustment, arm adjustment, lumbar support, cushion airflow, mesh attachment and modular base frame assembly.

The various subfeatures of these modular components are the subject of the following individual applications filed of even date herewith, all commonly assigned, the disclosures of which are incorporated in full by reference:

- Multi-position Tilt Limiting Mechanism, application Ser. No. 09/882,500
- Locking Device for Chair Seat Horizontal Adjustment Mechanism, application Ser. No. 09/881,896.
- Height and Pivot Adjustable Chair Arm, application Ser. No. 09/881,818.
- Lumbar Support for a Chair, application Ser. No. 09/881,795.
- Body Support Member, application Ser. No. 09/882,503.
- Chair Back Construction, application Ser. No. 09/882,237.
- Chair of Modular Construction, application Ser. No. 09/881,897.

In each of these cases, features combine to provide an overall chair that is a significant improvement over the prior art.

Thus, for example, the present invention provides a reclining chair having a four bar linkage system that causes the rear of the seat to elevate as the back is reclined lending an unusual and comfortable balance during reclining. A tilt limit control conveniently and effectively limits the degree of chair back tilt to one of three reclined positions by manual movement of a simple lever. Horizontal positioning of the chair seat cushion is accomplished using a simple locking device that allows the chair user to simply lift up on the front of the cushion and select a preferred horizontal cushion position. Height and pivot adjustable chair arms are actuated with the push of a button by gas cylinders lending convenient adjustment to suit a specific work task. A lumbar support is easily height adjustable, by providing tension to the back frame and requires no screws or adjustment knobs in its adjustment mechanism. A modular cushion includes a comfortable heat absorbing gel layer and is vented uniquely for air circulation. The back of the chair is of fabric mesh construction and includes a novel attachment system for superior comfort. The base of the chair is of modular construction that provides for ease of assembly and lends rigidity to the chair construction.

The present invention improves over the prior art by providing an ergonomic chair having a four-bar linkage arrangement wherein a lower frame member is provided with a rigid front support and a rigid rear support with a seat member pivotably connected to the front support. A back rest has an upper support pivotably connected at an upper end of the rear support of the lower frame member. A link member pivotably connects at a first end to a rear support of the seat member and at second end to a lower support of the back rest. This novel arrangement permits tilting movement of the backrest rearwardly relative to the lower frame member causing elevation of a rear portion of the seat member, permitting the feet to remain on the floor and alleviating pressure on the user's thighs. This is accomplished by a linkage mechanism creating an instantaneous center of rotation of the chair seat and back that is approximately at the user's hip. A further advantage is that the movement of the seat and back reduces undesirable "shirt pull." Still further, the user sitting in the chair will feel a weight reduction effect as a result of lift of the seat back during reclining. The apparent weight reduction will be sensed as lightness and give the feel of comfort.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
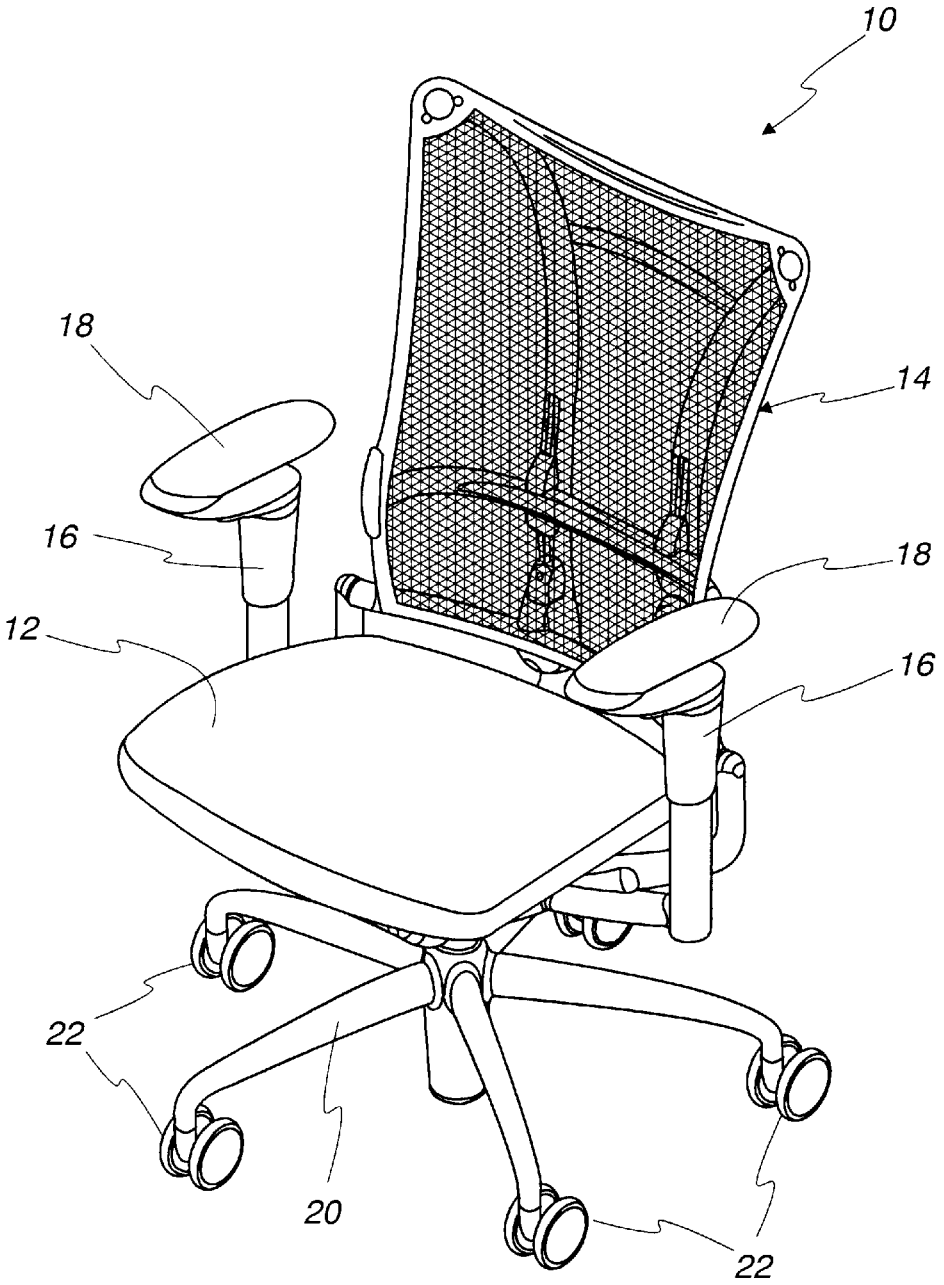
FIG. 1 is a left front perspective view of an ergonomic chair constructed in accordance with the principles of the invention and incorporating all of the improved modular components.
Figure 2:
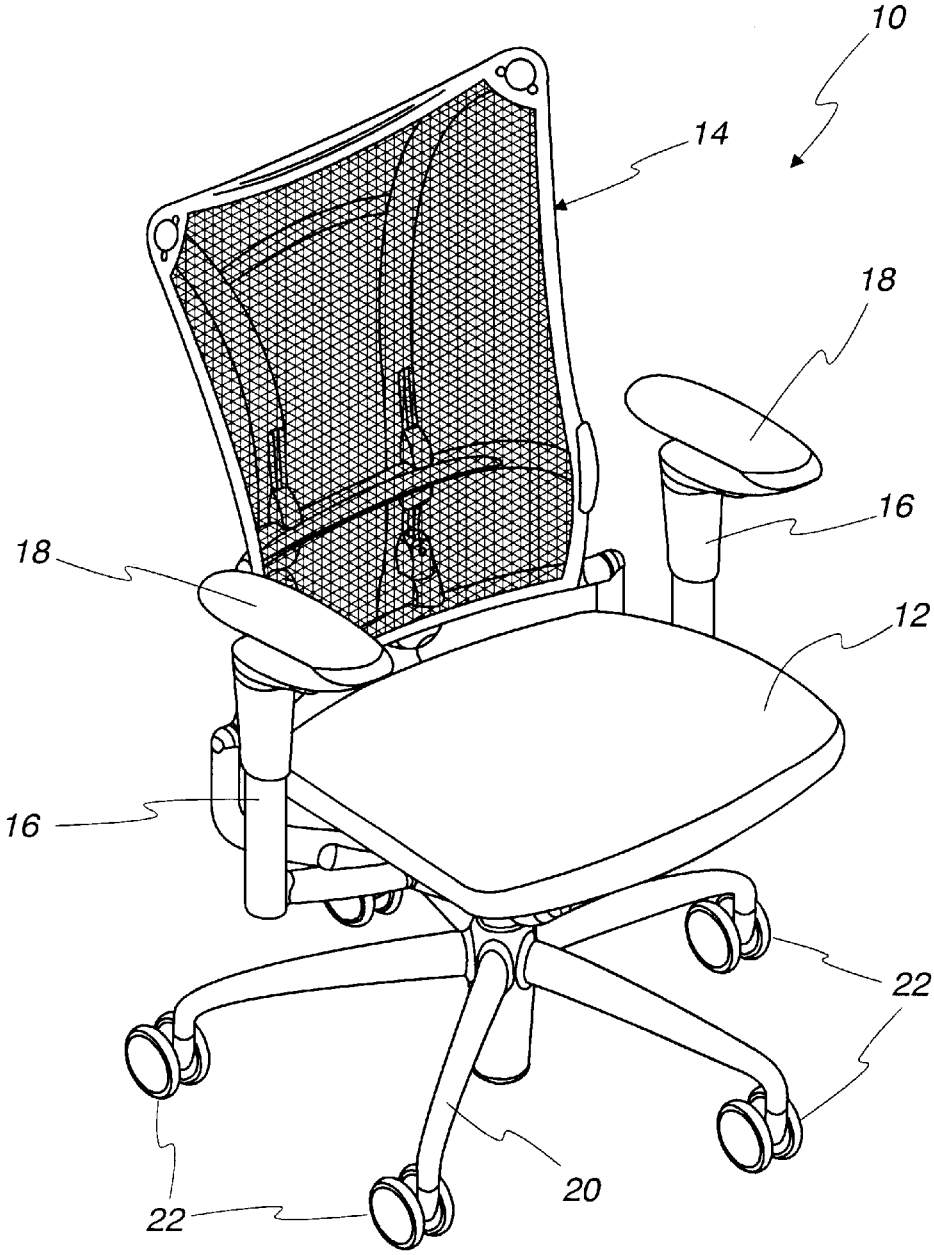
FIG. 2 is a right front perspective view thereof.
Figure 2A:
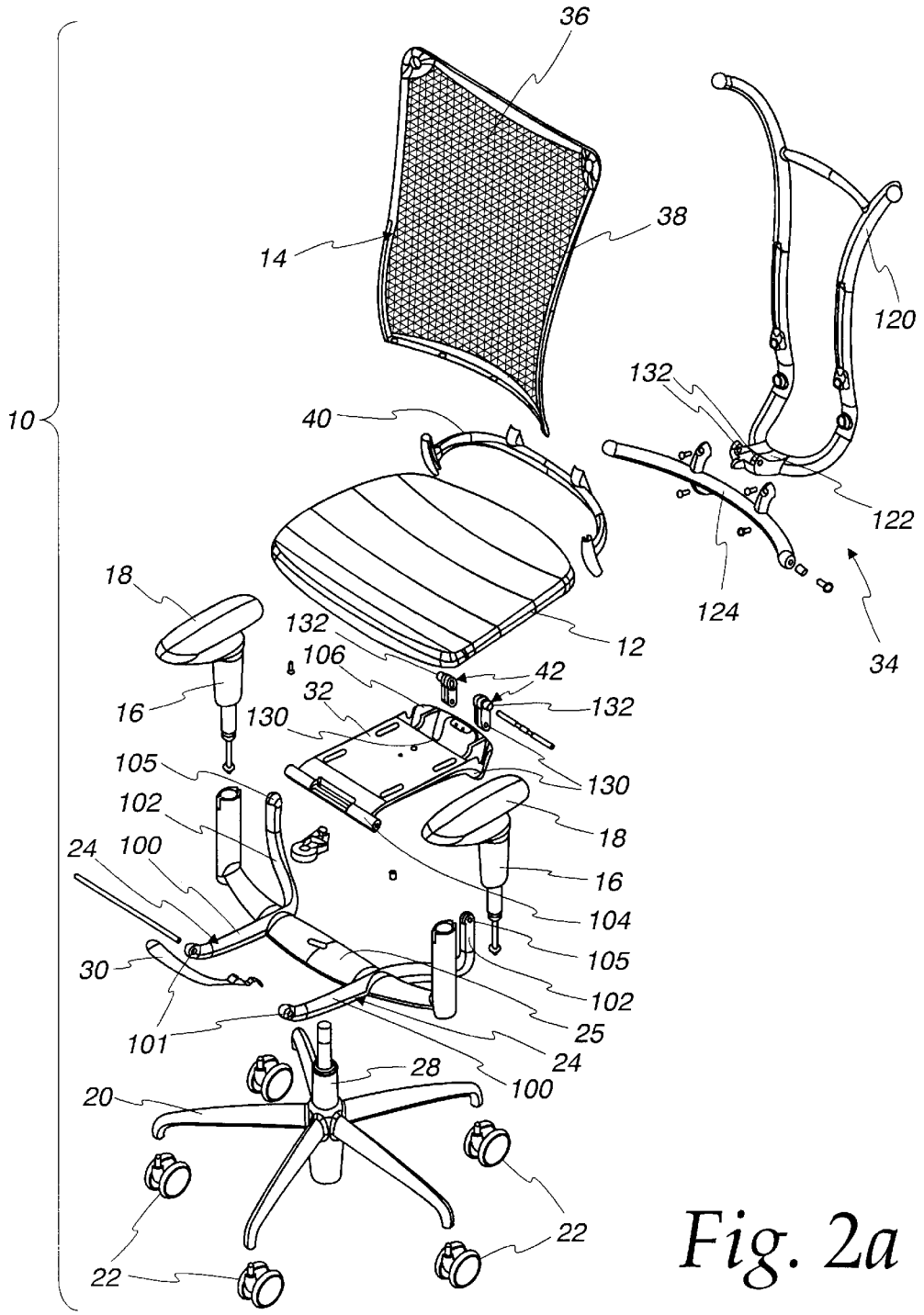
FIG. 2*a* is an exploded perspective view thereof.
Figure 3:
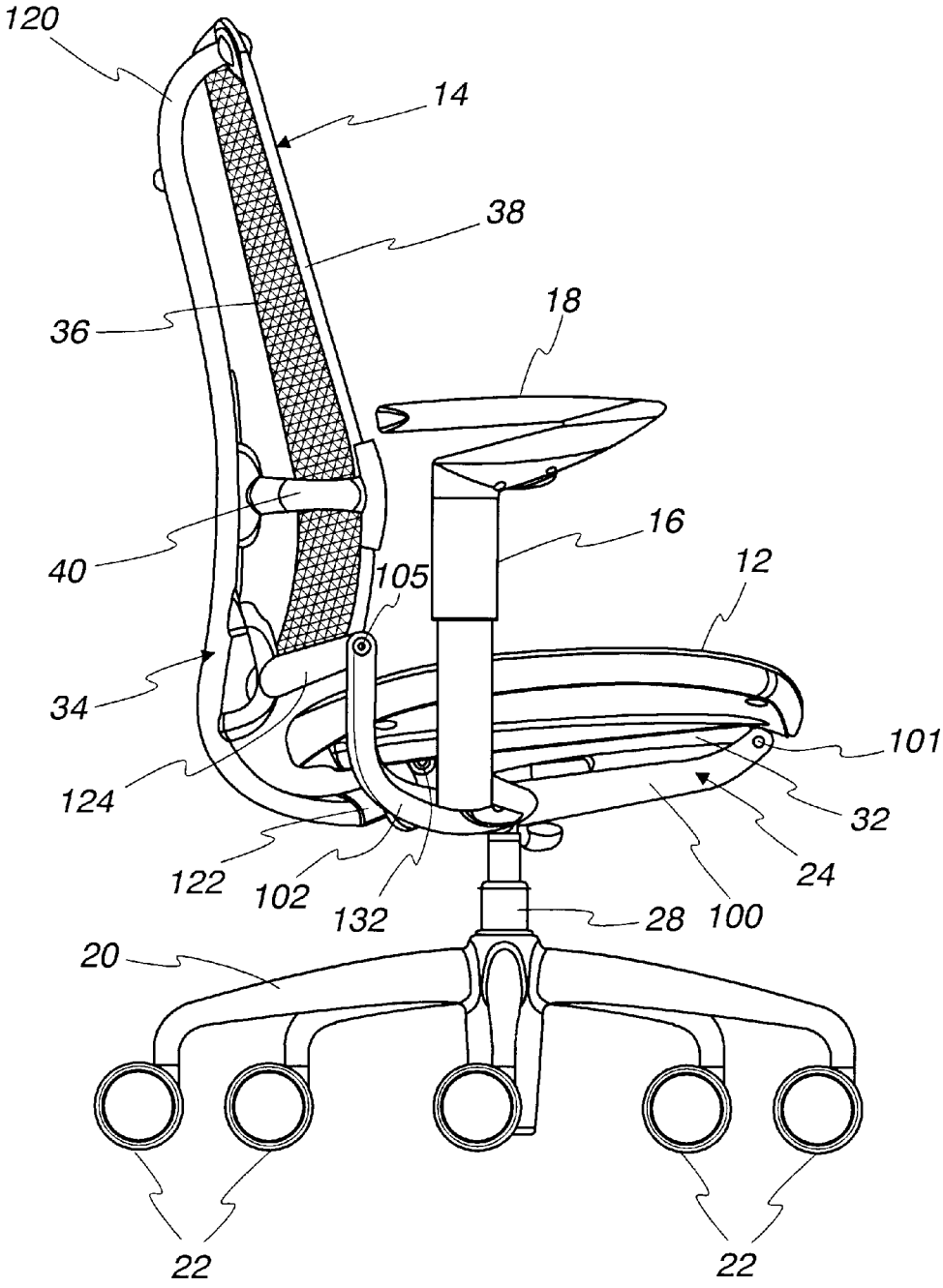
FIG. 3 is a right side view thereof.
Figure 4:
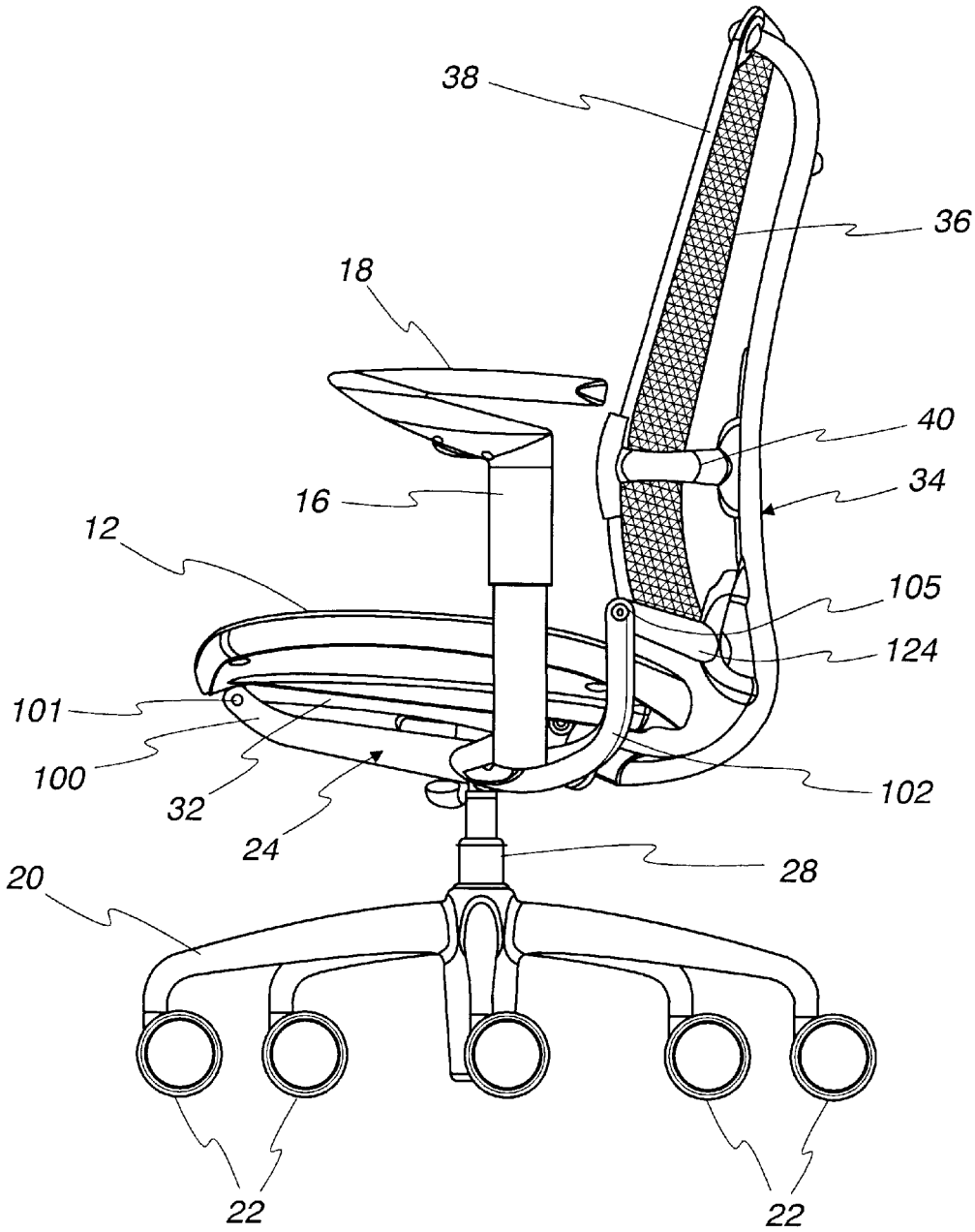
FIG. 4 is a left side view thereof.
Figure 5:
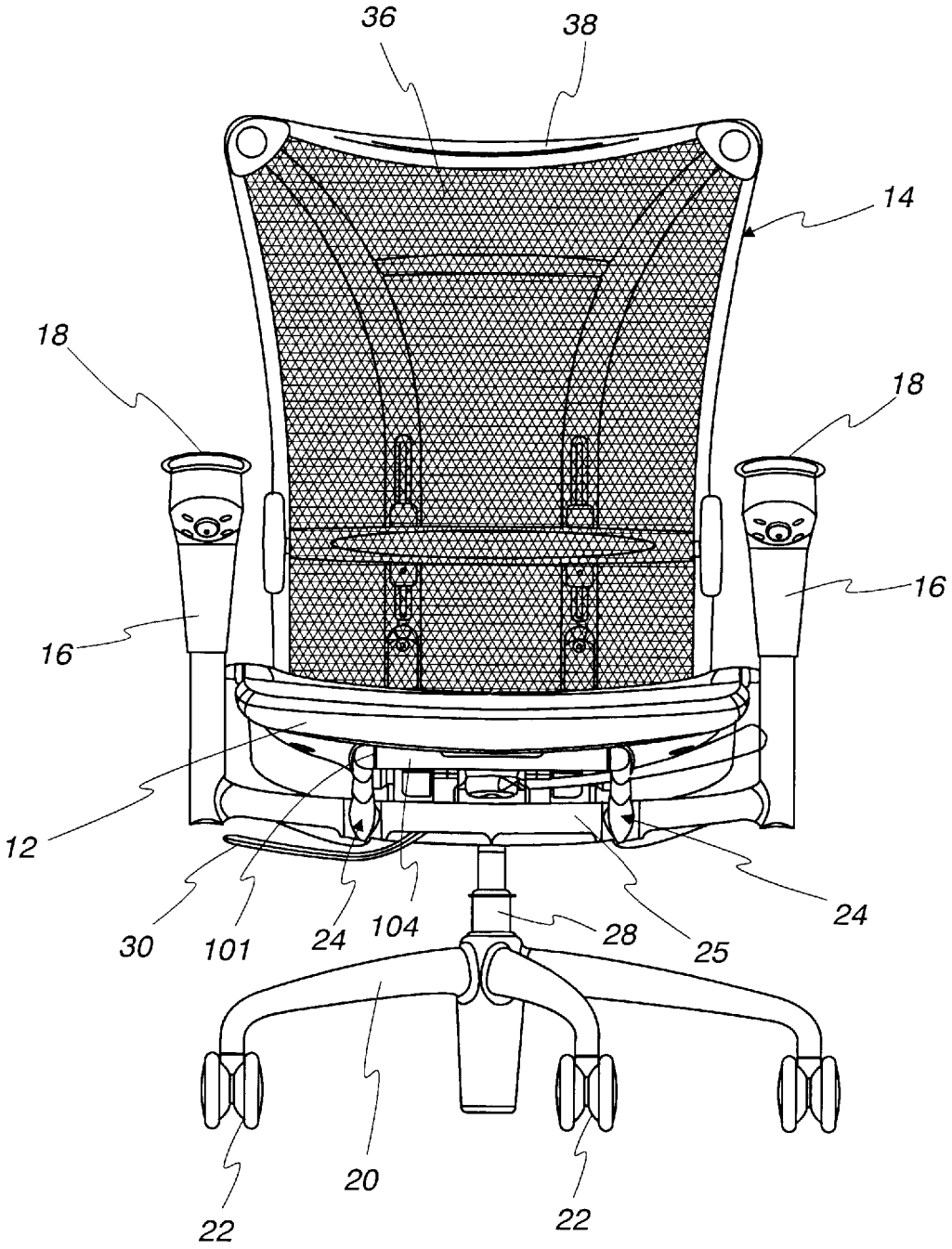
FIG. 5 is a front view thereof.
Figure 6:
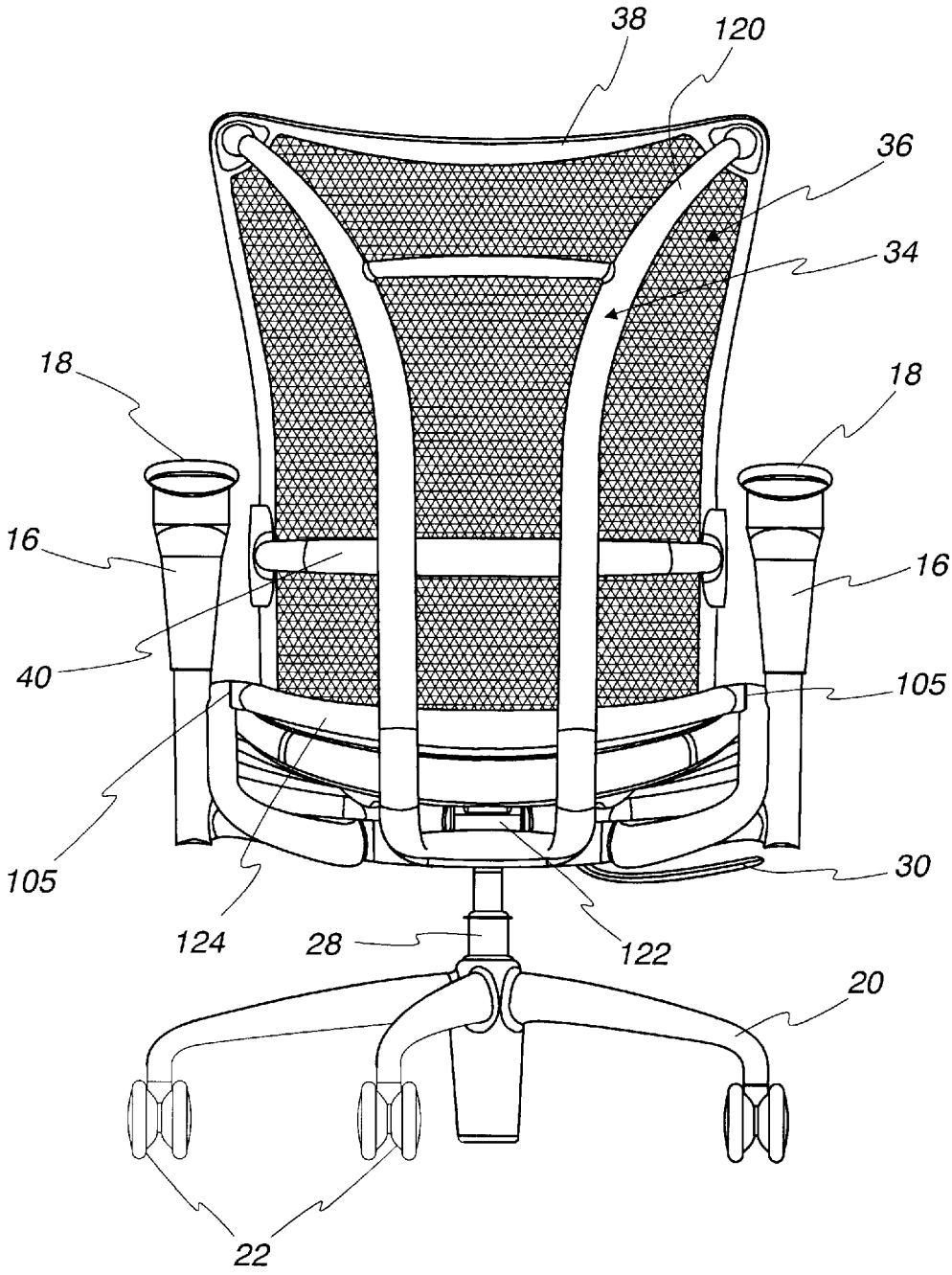
FIG. 6 is a rear view thereof.
Figure 7:
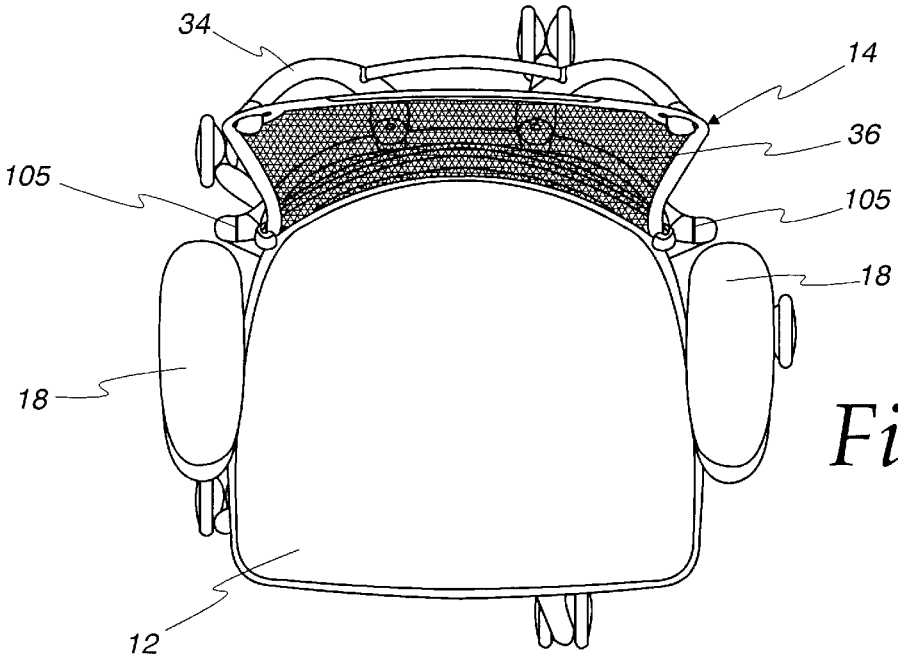
FIG. 7 is a top view thereof.
Figure 8:
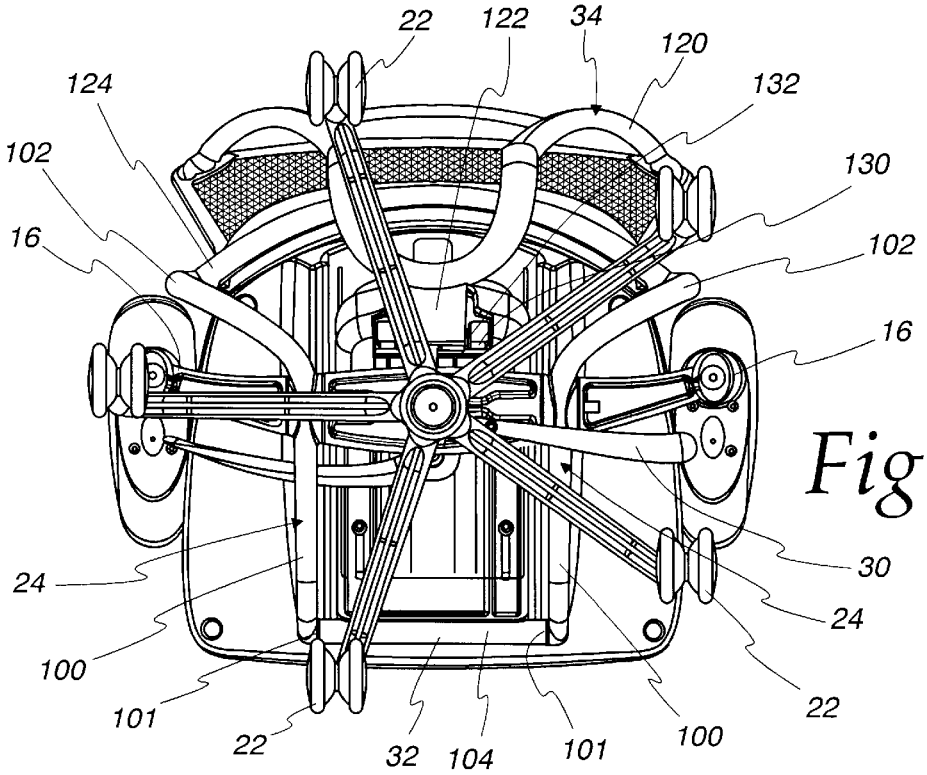
FIG. 8 is a bottom view thereof.

Referring now to the drawings, and initially to FIGS. 1, 2 and 2*a*, an improved ergonomic chair constructed in accordance with the numerous principles of the invention is shown in front perspective and designated generally by the reference numeral 10. The chair 10 comprises as its principal components a seat 12 and back 14. Suitable arms 16 having upper pads 18 may be provided. The chair 10, in a conventional manner, may be supported on a spider base 20 movable on casters 22.

As shown in FIGS. 3–9, the chair 10 is so constructed as to have synchronous movement of the seat 12 and back 14. To this end, a pair of main seat and back supports 24 are rigidly attached to a central support module 25 having a hub 26 for frictionally receiving the upper end of a gas cylinder 28. The seat and back supports include first or front support portions 100 forming front pivots 101 and second or rear support portions 102 forming rear pivots 105. The gas cylinder 28 is preferably a two-stage type available from Stablis GmbH of Germany. This cylinder 28 is operable by a manually pivotable lever 30 which activates the cylinder 28 for height and the adjustability of the chair 10 in a manner well-known in the art. The chair arms 16 are rigidly connected to the supports 24. A seat pan 32 is pivotably connected at its front end portion 104 to the pivots 101 of the forward end portions 100 of the supports 24. A back frame 34 is generally vertically disposed and includes a top part 120, a bottom part 122 and a middle part 124. The back 14 is connected to the top and middle parts of the back frame. The back frame is pivotably connected at its middle part to rear pivots 105 of the rear support portions 102 of the supports 24. The chair back 14 in the preferred embodiment is of fabric mesh 36 construction supported around its periphery by a carrier 38. An adjustable lumbar support member 40 slidably connects to the carrier 38 and bears against the back frame assembly 34.

Figure 10:
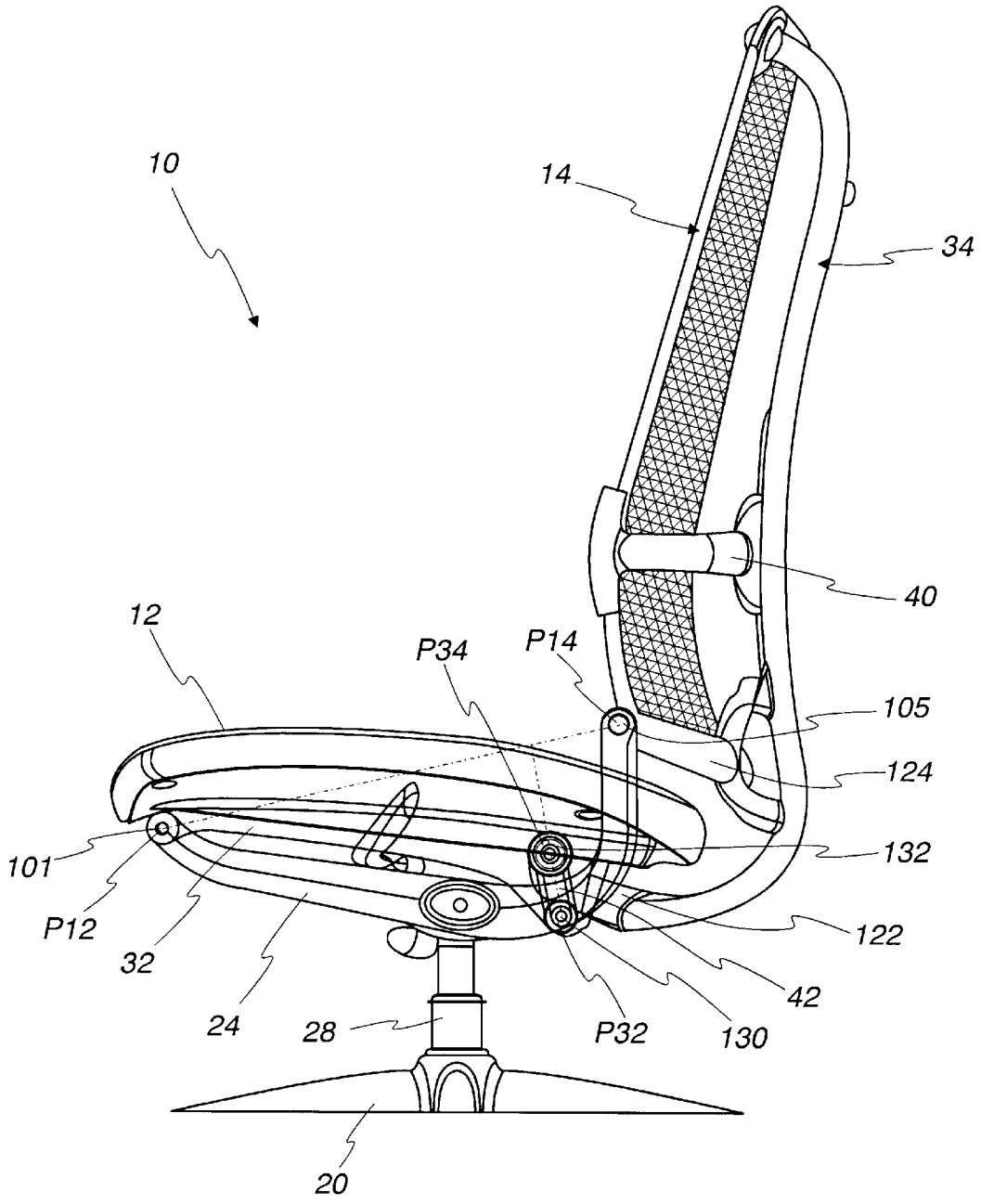
FIG. 10 is a partial left side view illustrating the chair in a fully upright position.
Figure 10A:
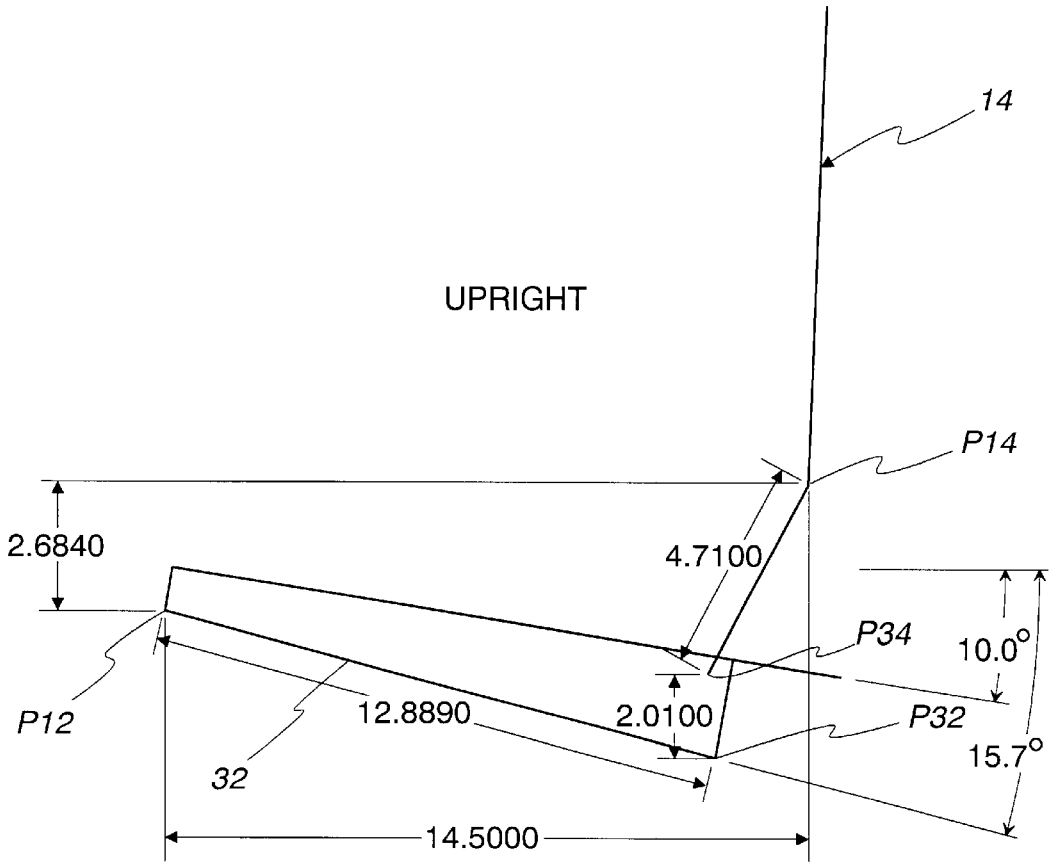
FIG. 10*a* is a side schematic view showing the preferred dimensional relationships between the chair components with the chair back in a fully upright position.
Figure 11:
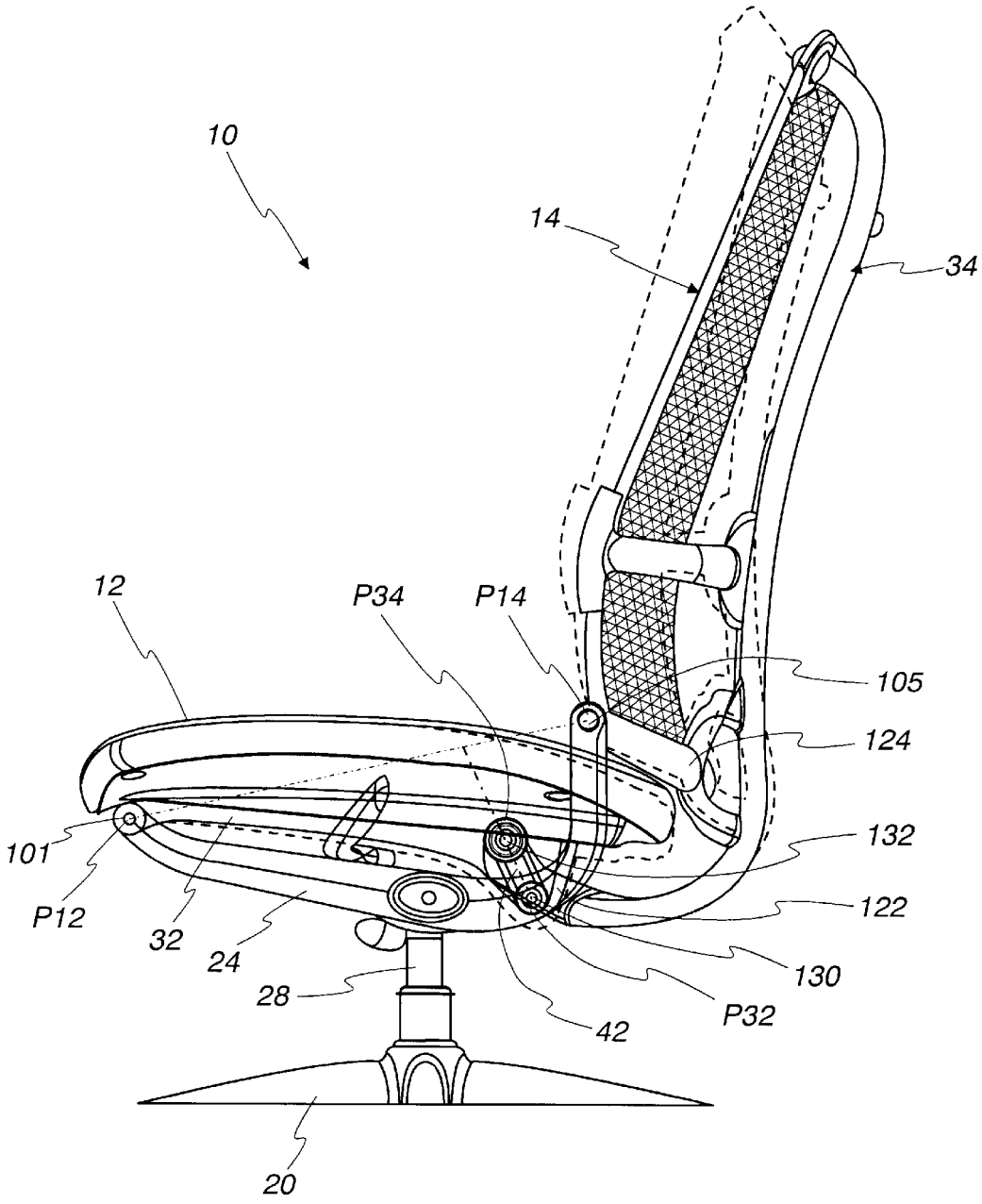
FIG. 11 is a partial left side view of the chair shown in a partially reclined position.
Figure 12:
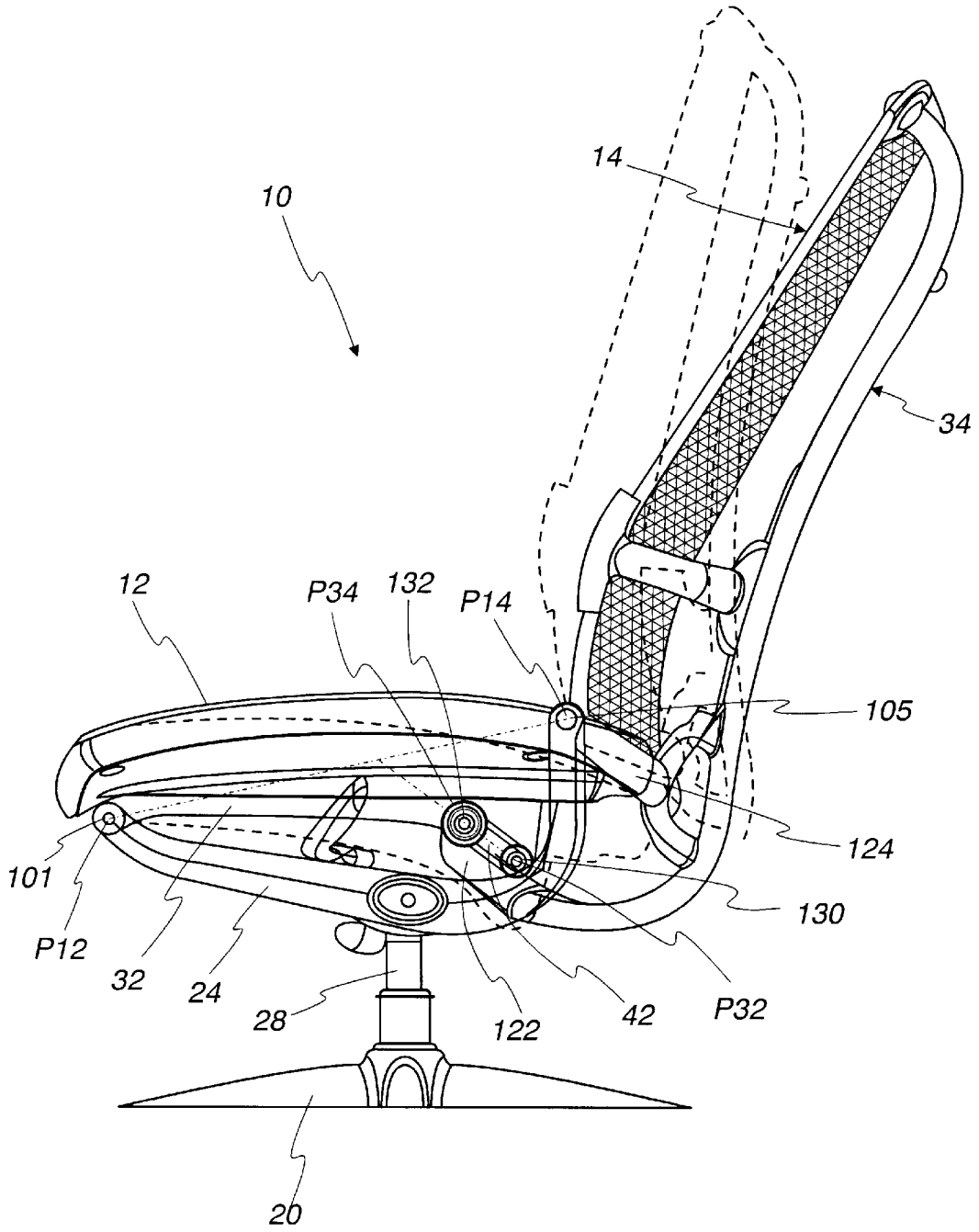
FIG. 12 is a partial left side view of the chair shown in a fully reclined position.
Figure 12A:
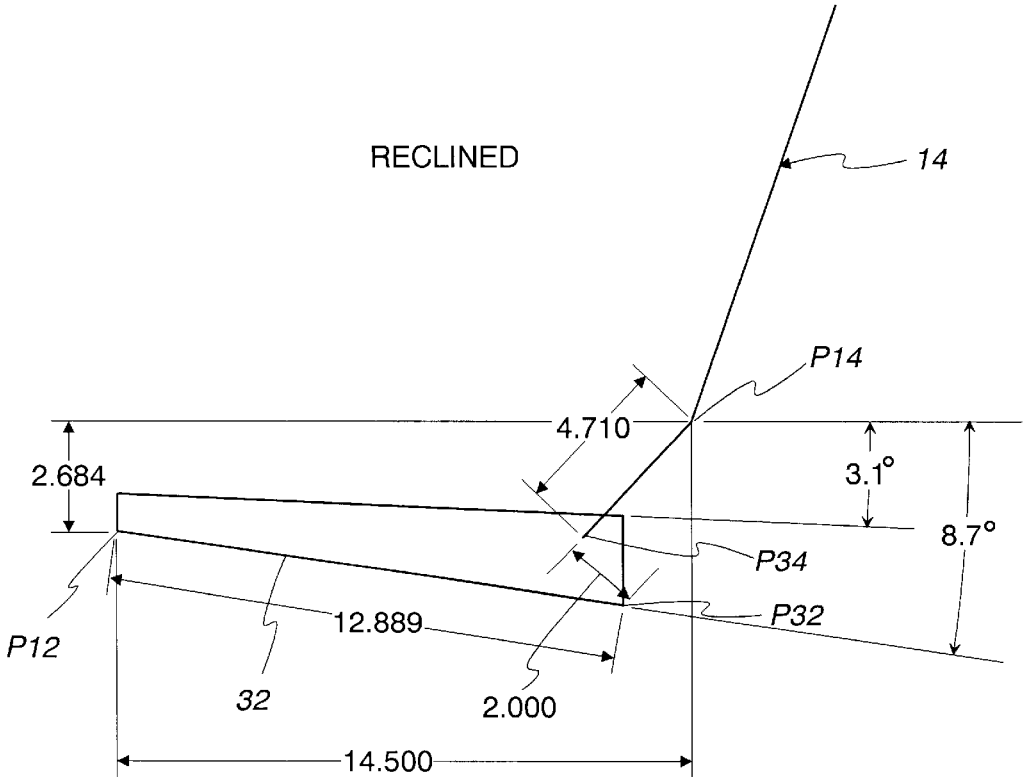
FIG. 12*a* is a side schematic view showing the preferred dimensional relationships between the chair components when the chair back is in a fully reclined position.

The relative positions of the seat 12 and back 14 of the chair 10 during reclining of the back 14, can be seen in the side views of FIGS. 10–12. As illustrated in these views, the chair seat pan 32 is pivotably connected at its front end portion 104 to the pivots 101, also known as pivot points $P_{12}$ of the supports 24, (only one of which can be seen). At the rear 106 of the seat pan 32 another set of pivots 130 are formed, also known as rear pivots $P_{32}$. These are connected to a pair of links 42 (only one of which can be seen). Each link 42 in turn is pivotably connected at pivots 132 (also known as pivot point $P_{34}$) to forward extensions of the bottom part 122 of the back frame assembly 34. The back frame assembly is also pivotably connected through its middle part 124 at point $P_{14}$ (also known as pivots 105) to the two supports 24. As shown in the dimensional schematic FIG. 10*a*, when the chair back 14 is in a fully upright position the seat pan 32 in one preferred form is inclined to the rear and forms an angle of about 15.7 degrees from horizontal although this angle can be in a range of between about 10 and 20 degrees. The distance between pivot points $P_{12}$ and $P_{32}$ is about 12.889 inches and the distance between pivot points $P_{32}$ and $P_{34}$ of the links 42 is approximately 2.01 inches although these distances can be in ranges of between about 10 and 15 inches and about 1.5 to 2.5 inches, respectively. Further, the distance between pivot points $P_{14}$ and $P_{34}$ is approximately 4.71 inches while the horizontal distance between pivot points $P_{12}$ and $P_{14}$ may be in a range of between about 12 and 17 inches. As shown in the three stages of back tilt illustrated in FIGS. 10–12, as the back 14 reclines rearwardly, the link 42 moves in a counterclockwise direction of rotation causing the rear of the seat pan 32 to elevate relative to its front. In the fully reclined position of the back 14 as shown in the schematic of FIG. 12*a* the seat pan preferably reduces its angle of inclination with horizontal from 15.7 degrees (FIG. 10*a*) to 8.7 degrees while the afore-described distances between all pivot points remains constant. The reduced inclination angle may be in a range of between about 6 and 10 degrees. This synchronous motion of the seat pan 32 and back 14 provides for an exceptionally comfortable reclining motion of the chair 10 user to aid in avoiding fatigue as the user is performing various work-related tasks.

Figure 13:
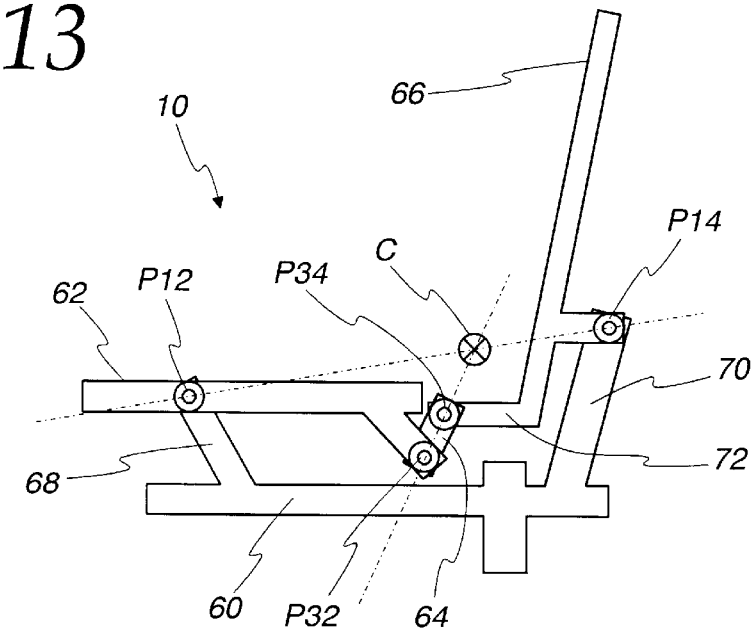
FIG. 13 is a side schematic view showing the linkage arrangement of the chair.
Figure 14:
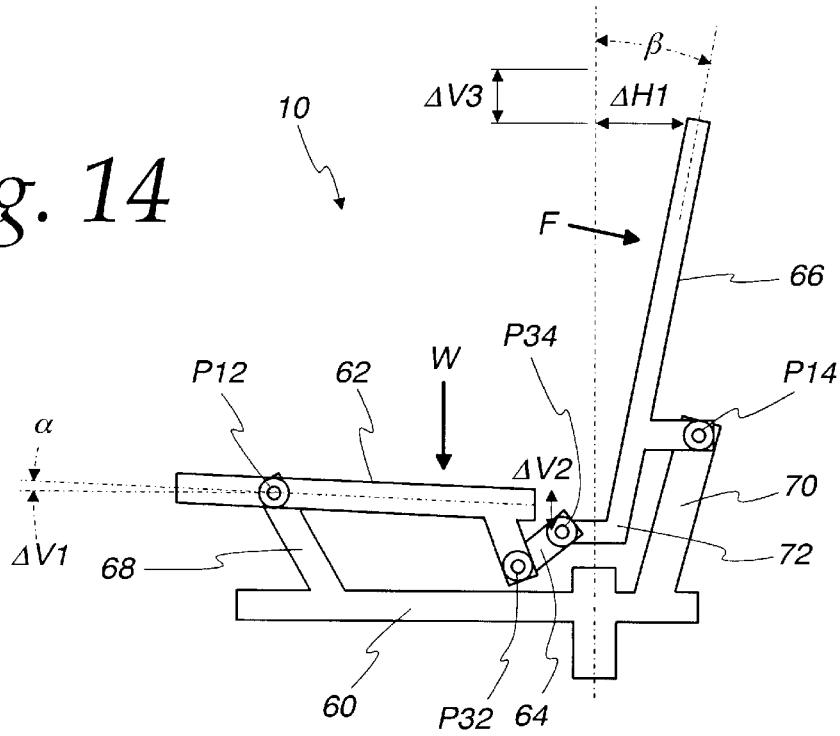
FIG. 14 is a side schematic view showing the kinematics of the chair.

Shown now in FIGS. 13 and 14 are schematic views of the synchronous seat and back tilt feature employing a four-bar mechanism which allows the rear of the seat to elevate as the backrest is reclined. The mechanism is designed to immediately respond to a user exerting a back force and/or self-weight on the seat. This function allows for reclining of the chair 10 about a rotation point C that is very closely coincident with the pivot axis of the user's hips and avoids undesirable "shirt pull" of the user. Because the rear of the seat is elevated during back reclining, excess pressure is relieved at the front underside of the user's thighs, and also a relatively constant gaze angle is maintained during reclining. This provides for adequate fluid circulation in the user's legs and avoids swelling. To accomplish the foregoing advantages, the chair 10 comprises four basic members and four rotationally-free pivots. The basic members include a floor supported member 60, a seat rest 62, a linking member 64 and a backrest 66. The floor supported member 60 has an upwardly directed portion 68 that terminates at an end defining pivot point $P_{12}$ to which the seat rest 62 is pivotably connected at its forward portion. The member 60 also has an upwardly directed portion 70 which terminates at an end defining pivot point $P_{14}$ to which the backrest 66 is pivotably connected. A lower portion 72 of the back rest 66 is pivotably connected at point $P_{34}$ to the linking member 64 and a downwardly extending portion 74 of the seat rest 62 is pivotably connected at point $P_{32}$ to the other end of the linking member 64.

The kinematics of the chair 10 are illustrated in FIG. 14. As force F is applied on the backrest 66, the back tilt angle $\beta$ increases, eye location shifts backwards an amount $\Delta H1$, and eye elevation decreases by an amount $\Delta V3$. The change in back tilt angle $\beta$ transmits motion by way of the upper and lower back pivots $P_{14}$ and $P_{34}$, respectively, to the linking member 64. As a result of motion set in linking member 64, the rear seat pivot $P_{32}$ moves in coordination with pivot $P_{34}$ in a composite rotational and translation motion. As the seat rest 62 rotates about pivot $P_{12}$, a lift $\Delta V2$ is caused in the rear part of the seat rest 62 relative to its front edge $\Delta V1$ in the amount $\Delta V2-\Delta V1$, therefore introducing a seat rest angle $\alpha$. The user sitting in the chair will feel a weight reduction effect as a result of the lift. The apparent weight reduction will be sensed as lightness and give the feel of comfort.

Figure 9:
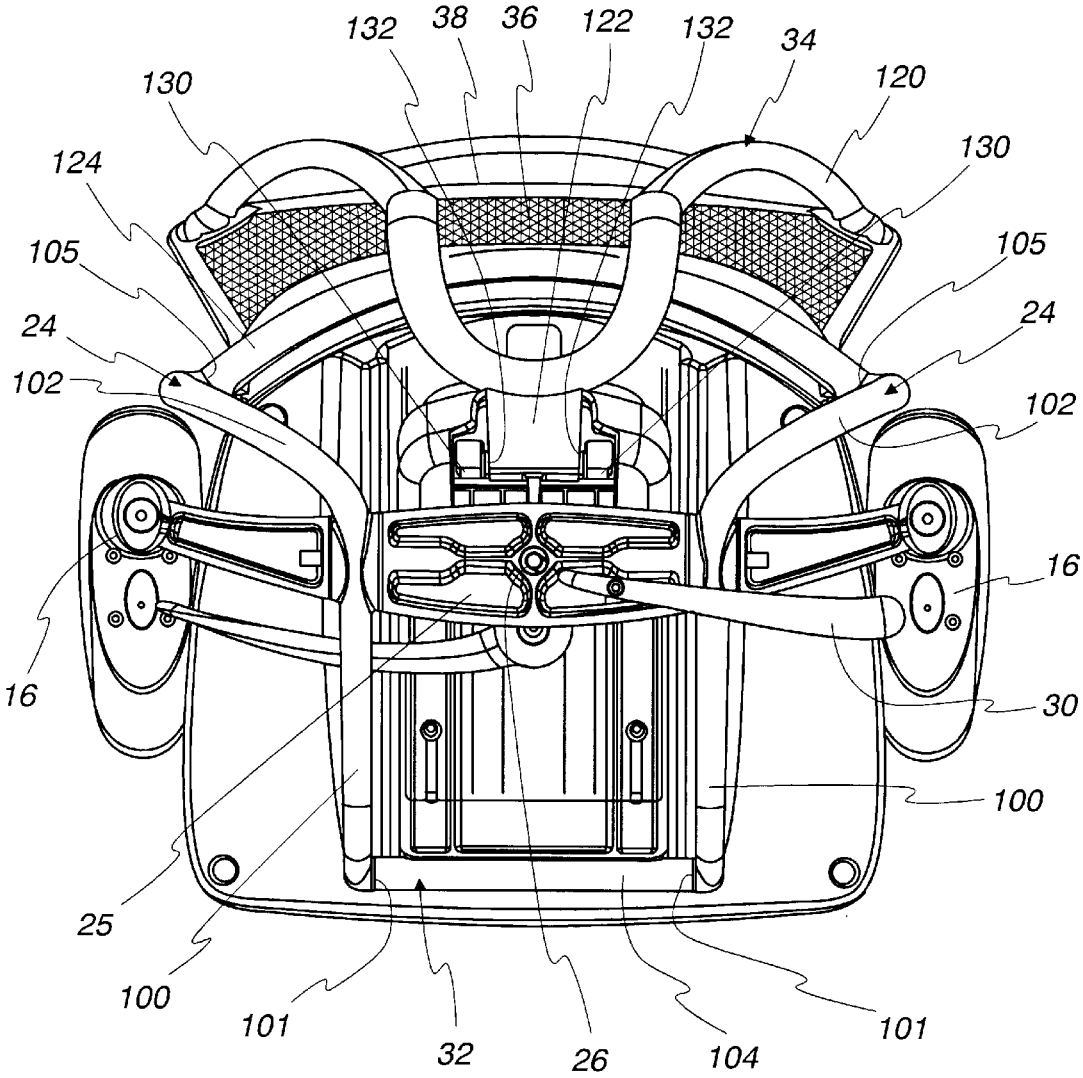
FIG. 9 is a bottom view thereof with the chair base removed.
Figure 9A:
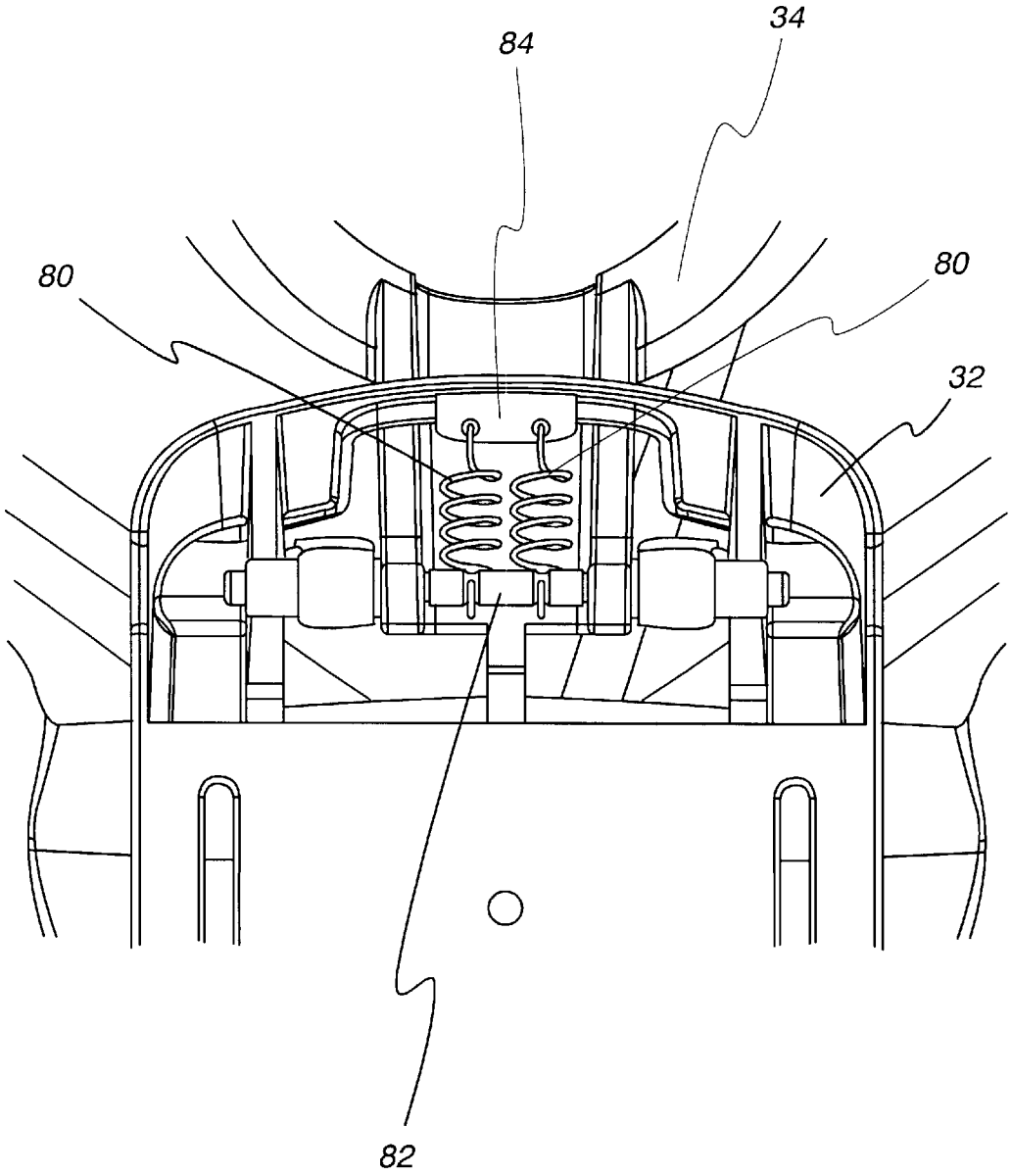
FIG. 9*a* is a partial top view of the chair seat with the cushion removed.

In order to assist the chair linkage mechanism in allowing the back 14 to maintain a fully upright position when the chair 10 is not in use, as shown in FIG. 9*a* one or more extension springs 80 may be connected between pivot shaft 82 and a rear edge portion 84 of the seat pan 32. The pivot shaft essentially defines pivot points $P_{34}$ and will cause a return force to be exerted on back frame assembly 34 by the springs 80.

It can now be appreciated that a chair 10 constructed according to the invention offers considerable advantages in user comfort by virtue of its synchronous linkage construction particularly where it is used for prolonged periods of time. The chair 10 is also cost effective to manufacture and assemble.

While the present invention has been described in connection with a preferred embodiment, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A chair comprising:

a frame member having a first support portion and a second support portion and a pair of space elongated rigid support members connected to opposite sides of a central control member;

a seat member pivotably connected to said first support portion and having a rear support;

a backrest member having an upper support portion and a front support portion, said upper support portion of the backrest being pivotably connected to an upper end of the second support portion of the frame member, said upper support portion of said backrest member includes a transverse frame member having opposite ends and each of said support members is connected to an end of said transverse frame member; and a link member pivotably connected to the rear support of the seat member and pivotably connected to the front support of the backrest member;

wherein tilting movement of the backrest rearwardly relative to the frame member causes elevation of a rear portion of the seat member upon weight shifting of the chair user and wherein the seat member and backrest member have a relative center of rotation approximately coincident with the center of rotation of the hip joint of the user.

2. The chair of claim 1 wherein a fabric backrest is attached to said transverse frame member.

3. A chair comprising:

a frame member having first support portion and second support portion wherein said second support portion is disposed rearwardly of said frame member;

a seat member pivotably connected to said first support portion and having a rear support;

a backrest member having an upper support portion and a front support portion, the upper support portion of the backrest member being pivotably connected to an upper end of the second support portion of the frame member; and a link member pivotably connected to the rear support of the seat member and pivotably connected to the front support portion of the backrest member;

wherein tilting movement of the backrest rearwardly relative to the frame member causes elevation of a rear portion of the seat member upon weight shifting of the chair user and wherein the seat member and backrest member have a relative center of rotation approximately coincident with the center of rotation of the hip joint of the user.

4. A chair having a tiltable back and a pivoting seat comprising:

a base;

a support module attached to said base;

a generally horizontally extending frame having a lower front pivot and a higher rear pivot, said frame being rigidly attached to said base;

a seat mounted to said horizontally extending frame so as to be pivotable only about said lower front pivot, said seat having a rear portion including a third pivot;

a back frame disposed generally vertically and moveable between upright and tilted positions, said back frame having a top part, a bottom part and a middle part, said top and said middle parts for supporting a back, said bottom part being attached to a fourth pivot and said middle part being rotatably connected to said higher rear pivot; and a link member pivotably mounted to said third and said fourth pivots wherein the elevational distance between said third and fourth pivots is greater when said back frame is in said upright position than when said back frame is in said tilted position.

5. The chair of claim 4 wherein said seat member is inclined to the rear of the chair.

6. The chair of claim 5 wherein in a fully upright position of said backrest member said seat member is inclined to the rear of the chair at an angle in a range of between about 10 and 20 degrees from horizontal.

7. The chair of claim 6 wherein in a fully upright position of said backrest member said seat member is inclined to the rear of the chair at an angle of about 15.7 degrees from horizontal.

8. The chair of claim 5 wherein in a fully reclined position of said backrest member said seat member is inclined to the rear of the chair at an angle in a range of between about 6 and 10 degrees.

9. The chair of claim 8 wherein in a fully reclined position of said backrest member said seat member is inclined to the rear of the chair at an angle of a bout 8.7 degrees from horizontal.

10. The chair of claim 4 wherein the distance between the pivotable connection of the seat member and the first support portion to the pivotable connection of the link member and the rear support of the seat member is in a range of between and 10 and 15 inches.

11. The chair of claim 10 wherein the distance between the pivotable connection of the seat member and first support portion to the pivotable connection of the link member and the rear support of the seat member is approximately 12.889 inches.

12. The chair of claim 4 wherein the horizontal distance between the first support portion of said frame member and the upper end of the second support portion of the frame member is in a range of between about 12 and 17 inches.

13. The chair of claim 12 wherein the horizontal distance between the first support portion of said frame member and the upper end of the second support portion of the frame member is approximately 14.5 inches.

14. The chair of claim 4 wherein the distance between the pivotable connections of said link member is in a range of between about 1.5 to 2.5 inches.

15. The chair of claim 14 wherein the distance between the pivotable connections of said link is about 2.01 inches.

16. The chair of claim 4 wherein the distance between the front support portion of the back rest member and the link member pivotable connection thereto is in a range of between about 3 and 6 inches.

17. The chair of claim 16 wherein the distance between the front support portion of the backrest member and the link member pivotable connection thereto is about 4.7 inches.

18. A chair comprising:

a frame member having a first support portion and a second support portion;

a seat member pivotably connected to said first support portion and having a rear support;

a backrest member having an upper support portion and a few support portion, the upper support portion of the backrest member being pivotably connected to an upper end of the second support portion of the frame member;

a link member pivotably connected to the rear support of the seat member and pivotably connected to the front support portion of the backrest member; and at least one extension spring connected between the seat member and a pivot shaft which defines the pivotal connection between the link member and the front support portion of the backrest member;

wherein tilting movement of the backrest rearwardly relative to the frame member causes elevation of a rear portion of the seat member upon weight shifting of the chair user and wherein the seat member and a backrest member have a relative center of rotation approximately coincident with the center of rotation of the hip joint of the user.

* * * * *